US006340292B1

(12) United States Patent
Chuang et al.

(10) Patent No.: US 6,340,292 B1
(45) Date of Patent: Jan. 22, 2002

(54) ANTI-FRACTURE FAN STRUCTURE

(75) Inventors: Te-tsai Chuang; Wei-chen Kuo; Kuo-cheng Lin; Wen-shi Huang, all of Taoyan (TW)

(73) Assignee: Delta Electronics, Inc., Taoyan Shien (TW)

( * ) Notice: Subject to any disclaimer, the term of this patent is extended or adjusted under 35 U.S.C. 154(b) by 0 days.

(21) Appl. No.: 09/628,092

(22) Filed: Jul. 28, 2000

(30) Foreign Application Priority Data

Apr. 8, 2000 (TW) ..... 089205615

(51) Int. Cl.[7] ..... F04D 29/18
(52) U.S. Cl. ..... 416/244 R
(58) Field of Search ..... 416/244 R, 244 A, 416/244 B

(56) References Cited

U.S. PATENT DOCUMENTS 4,123,197 A * 10/1978 Keem et al. ..... 415/123
5,975,853 A * 11/1999 Lackey ..... 416/244 R
6,200,095 B1 * 3/2001 Bucher et al. ..... 416/5

* cited by examiner

*Primary Examiner*—Edward K. Look
*Assistant Examiner*—James M McAleenan
(74) *Attorney, Agent, or Firm*—Darby & Darby

(57) ABSTRACT

The invention provides an anti-fracture fan structure including a hub, a plurality of blades, and a plurality of ribs. The hub has an inner surface formed inside and encircling it. The plurality of blades are arranged outside and around the hub. The plurality of ribs projects from the inner surface of the hub into the inside of the hub. Each of the plurality of ribs is not perpendicular to the inner surface of the hub. Furthermore, the anti-fracture fan further includes a shielding-can situated inside the hub and in contact with the plurality of ribs. Moreover, the hub can be formed of a plastic material and the shielding-can can be formed of a metal material. The ribs can be easily warped when the shielding-can expands.

5 Claims, 2 Drawing Sheets

ANTI-FRACTURE FAN STRUCTURE

FIELD OF THE INVENTION

The invention relates to an anti-fracture fan structure, particularly to an anti-fracture fan structure that has a plurality of ribs in predetermined shapes to prevent the fan from fracturing due to heat expansion.

BACKGROUND OF THE INVENTION

A fan is widely used to dissipate heat generated by electrical devices such as desktop computers or notebook computers. FIG. 1 is a schematic illustration that shows a conventional fan structure. Referring to FIG. 1, the fan includes a hub 11 and a shielding-can 12. The hub 11 has an inner surface 111. A plurality of blades 112 are arranged around the hub 11. A plurality of ribs 113 are provided around the inner surface 111.

The hub 11 is usually made of a material such as plastic or resin. The shielding-can 12 is usually made of a metallic material that has a high strength property, and is mounted inside the hub 11 by press fitting in order to prevent a ring-shaped magnet (not shown), that is situated around the inner surface of the hub 11, from being deformed. Thus, the magnetic leakage phenomenon can be avoided.

The ribs 113 are useful for mounting the shielding-can 12 into the hub 11 and preventing the hub 11 from being fractured.

In general, the fan starts operating at a lower temperature. The temperature of the fan gradually rises owing to the heat energy generated from the fan or the heat energy transferred from a heat sink (not shown). For example, it is possible that the temperature of the fan rises from −10° C. to 50° C.

However, the hub 11 and the shielding-can 12 have different heat expansion coefficients because the hub 11 and the shielding-can 12 are made of different materials. For example, the heat expansion coefficient of a PC (poly carbonate) material constituting the hub 11 is about $2.5\times10^{-7}$ in/in °F., while the heat expansion coefficient of a metal material constituting the shielding-can 12 is about $6.5\times10^{-6}$ in/in °F., which is 26 times as large as that of the PC material. As a result, if the fan is subjected to heat energy, the shielding-can 12 expands faster than the hub 11, causing the hub 11 to fracture from the pressure of the expanding shielding-can 12.

SUMMARY OF THE INVENTION

To overcome the above drawback, it is therefore an object of the invention to provide an anti-fracture fan structure in which the hub is not easily fractured by the pressing force of the shielding-can when the fan expands.

To achieve the above objective, there is provided an anti-fracture fan structure including a hub, a plurality of blades, and a plurality of ribs. The hub has an inner surface formed inside and encircling it. The plurality of blades are arranged outside and around the hub. The plurality of ribs projects from the inner surface of the hub into the inside of the hub. Each of the plurality of ribs is not perpendicular to the inner surface of the hub.

Furthermore, the anti-fracture fan further includes a shielding-can situated inside the hub and in contact with the plurality of ribs.

Moreover, the hub can be formed of a plastic material and the shielding-can can be formed of a metal material.

The ribs can be easily warped when the shielding-can expands. Therefore, the hub is not easily fractured by the expansion of the shielding-can when the fan expands with heat.

DETAILED DESCRIPTION OF THE PREFERRED EMBODIMENTS

An anti-fracture fan of a preferred embodiment in accordance with the invention is now described in detail with reference to the accompanying drawings.

Figure 2:
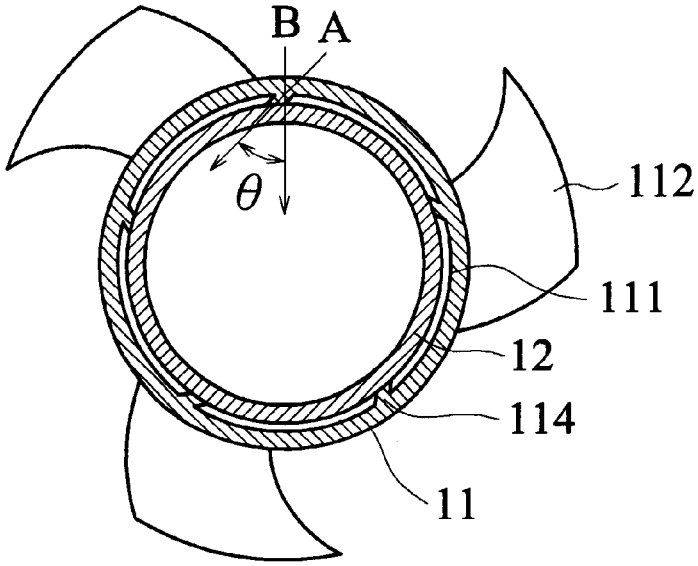
FIG. 2 is a schematic illustration showing the structure of an anti-fracture fan of an embodiment in accordance with the invention.

FIG. 2 is a schematic illustration showing the structure of an anti-fracture fan. Referring to FIG. 2, the fan includes a hub 11 and a shielding-can 12. The hub 11 has an inner surface 111. A plurality of blades 112 are arranged around the hub 11. A plurality of ribs 114 are provided on the inner surface 111.

It should be noted that a line A indicates the direction of extension of one of the ribs 114 while a line B indicates the radial direction of the rib 114 and also indicates the direction of extension of one of the ribs 113 if the ribs 113 are arranged as in FIG. 2.

The difference is that an angle θ between the line A and the line B is not zero degrees. In other words, each of the ribs is not perpendicular to the inner surface 111.

Figure 3:
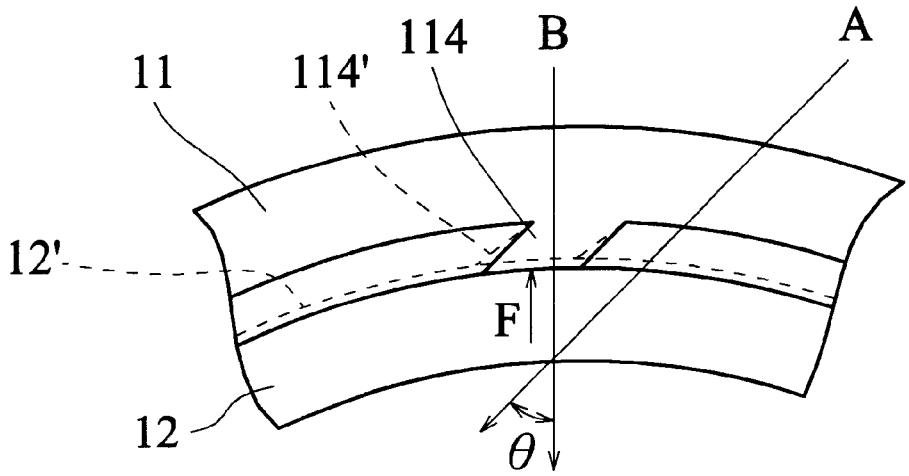
FIG. 3 is a partially enlarged schematic illustration showing the deformation of the anti-fracture fan in FIG. 2, wherein the deformation is caused by heat expansion.

Referring to FIG. 3 that is a partially enlarged schematic illustration showing the deformation of the anti-fracture fan caused by heat expansion. When the anti-fracture fan expands, the shielding-can 12 expands, becoming the shielding-can 12' and exerting force on the rib 114. The force that shielding-can 12 exerts on the rib 114 is indicated by an arrow F which is substantially parallel to the radial direction as indicated by the line B.

When the rib 114 is compressed, it is elastically deformed, becoming the rib 114' because the rib 114 is not perpendicular to the inner surface 111. In other words, the rib 114 will slightly warp when absorbing the force created by the expanded shielding-can 12.

Figure 1:
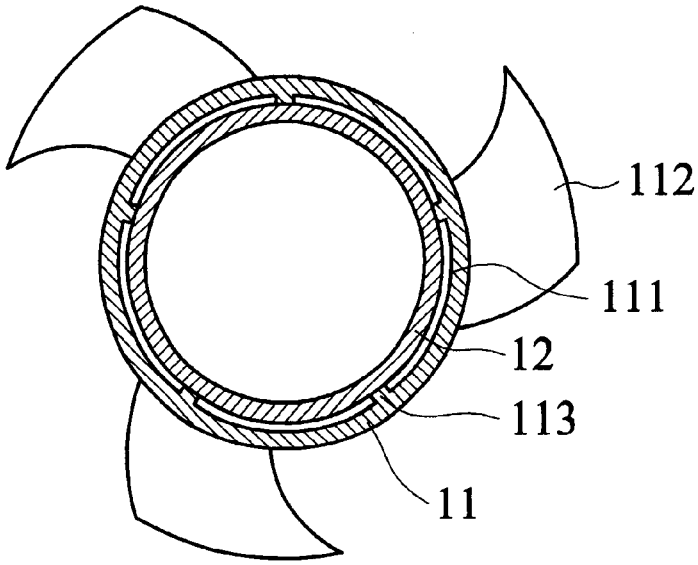
FIG. 1 (PRIOR ART)
FIG. 1 is a schematic illustration showing a conventional fan.

In the fan of the prior-art, as shown in FIG. 1, because the rib 113 is perpendicular to the inner surface 111 of the hub 11, the expanded shielding-can 12 exerts a compression force on the rib 113. In this situation, the compression force mainly acts on the hub 11, causing the hub 11 to be fractured.

However, in the anti-fracture fan as shown in FIG. 3, the ribs 114 can absorb most compression force by warping. Therefore, the expanded shielding-can 12 does not easily fracture the hub 11.

Figure 4:
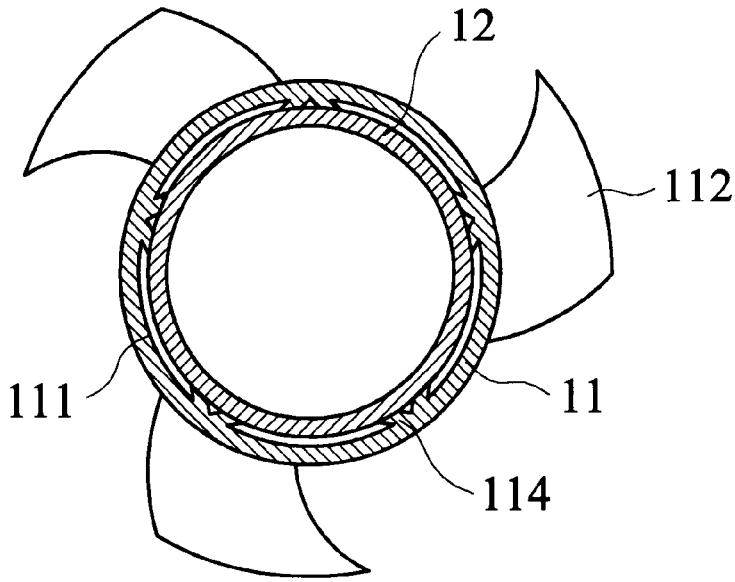
FIG. 4 is a schematic illustration showing a modification of the embodiment as shown in FIG. 2.

While the invention has been described by way of example and in terms of a preferred embodiment, it is to be understood that the invention is not limited to the disclosed embodiment. To the contrary, it is intended to cover various modifications. Therefore, the scope of the appended claims should be accorded the broadest interpretation so as to encompass all such modifications. For instance, the shapes of the ribs 114 can be modified to the shapes as shown in FIG. 4. In this case, each of the ribs 114 in FIG. 4 extends in two directions but still retains the same function as that of the above embodiment as shown in FIG. 3.

What is claimed is:

1. An anti-fracture fan structure comprising:

a hub having an inner surface formed inside and encircling said hub;

a plurality of blades arranged outside and around said hub; and a plurality of ribs projecting from said inner surface of said hub into the inside of said hub, wherein each of said plurality of ribs is not perpendicular to said inner surface of said hub.

2. The anti-fracture fan according to claim 1, further comprising a shielding-can situated inside said hub and contacting with said plurality of ribs.

3. The anti-fracture fan according to claim 2, wherein said hub is formed of a plastic material.

4. The anti-fracture fan according to claim 2, wherein said shielding-can is formed of a metal material.

5. The anti-fracture fan according to claim 1, wherein said hub is formed of a plastic material.

* * * * *